US009006989B2

(12) United States Patent
Powell et al.

(10) Patent No.: US 9,006,989 B2
(45) Date of Patent: Apr. 14, 2015

(54) CIRCUIT FOR DRIVING LIGHTING DEVICES

(71) Applicant: Colorado Energy Research Technologies, Littleton, CO (US)

(72) Inventors: Wayne J. Powell, Centennial, CO (US); Robert D. Boehmer, Centennial, CO (US); Lee L. Johnson, Littleton, CO (US)

(73) Assignee: Colorado Energy Research Technologies, LLC, Englewood, CO (US)

( * ) Notice: Subject to any disclaimer, the term of this patent is extended or adjusted under 35 U.S.C. 154(b) by 0 days.

(21) Appl. No.: 13/726,879

(22) Filed: Dec. 26, 2012

(65) Prior Publication Data

US 2014/0176000 A1 Jun. 26, 2014

(51) Int. Cl.
*H05B 37/02* (2006.01)
*H05B 33/08* (2006.01)

(52) U.S. Cl.
CPC ..... *H05B 33/0803* (2013.01)

(58) Field of Classification Search
USPC ..... 315/224, 291, 294, 297, 209 R
See application file for complete search history.

(56) References Cited

U.S. PATENT DOCUMENTS

| | | | | |
|---|---|---|---|---|
| 4,023,067 | A | 5/1977 | Zelina et al. | |
| 4,459,516 | A | 7/1984 | Zelina et al. | |
| 4,973,885 | A | 11/1990 | Kerwin | |
| 5,525,870 | A | 6/1996 | Matsuzawa et al. | |
| 5,739,639 | A | 4/1998 | Johnson | |
| 7,903,105 | B1 | 3/2011 | Lan et al. | |
| 8,288,942 | B2 | 10/2012 | Ibbetson | |
| 2005/0225259 | A1* | 10/2005 | Green | 315/224 |
| 2008/0157699 | A1 | 7/2008 | Lee et al. | |
| 2008/0272709 | A1* | 11/2008 | Green | 315/224 |
| 2010/0123405 | A1 | 5/2010 | Yu et al. | |
| 2010/0195016 | A1 | 8/2010 | Koh | |
| 2010/0259179 | A1 | 10/2010 | Bowling et al. | |

(Continued)

FOREIGN PATENT DOCUMENTS

| | | |
|---|---|---|
| JP | 2005-026431 | 1/2005 |
| WO | 2012/068687 | 5/2012 |

OTHER PUBLICATIONS

"Effect of Operating Frequency", LampTech, http://www.lamptech.co.uk/Documents/FL%20Frequency.htm, screen capture Nov. 14, 2012.

*Primary Examiner* — Tung X Le
*Assistant Examiner* — Jonathan Cooper
(74) *Attorney, Agent, or Firm* — Fish & Tsang LLP

(57) ABSTRACT

The inventive subject matter provides a circuit and a method for efficiently operating a lighting device, such as a light-emitting diode and a fluorescent lamp. In one aspect of the invention, the circuit includes an oscillator that generates a series of current pulses at a frequency that is at least 50,000 Hz and that corresponds to a resonant frequency of the circuit including the lighting device. The series of pulses is operated at a low duty cycle of no more than 15%. The lighting device has a manufacturer's specification for current consumption and power consumption for a specified luminosity. The circuit provides a current to the lighting device at no more than 1/500 of the manufacturer's specification to produce at least the specified luminosity. The lighting device also operates within the circuit at no more than 50% of the manufacturer's specification to produce the specified luminosity.

26 Claims, 2 Drawing Sheets

(56) References Cited

U.S. PATENT DOCUMENTS

2010/0277088 A1* 11/2010 Bodano ..... 315/283
2011/0215729 A1 9/2011 Feldtkeller
2012/0146534 A1 6/2012 Yu et al.
2013/0334980 A1* 12/2013 Zhou et al. ..... 315/250

* cited by examiner

FIG. 1
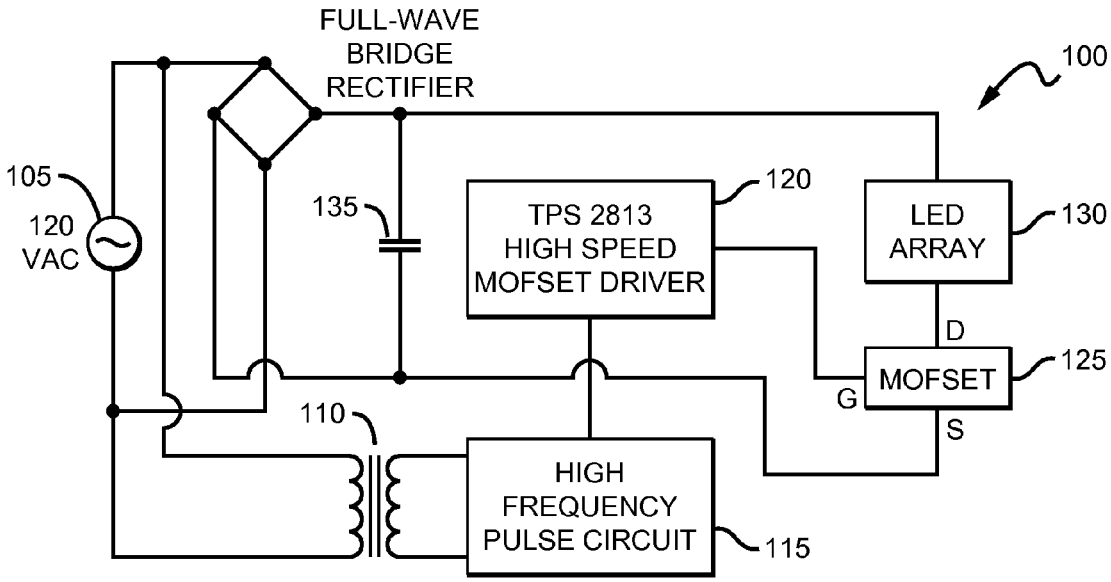
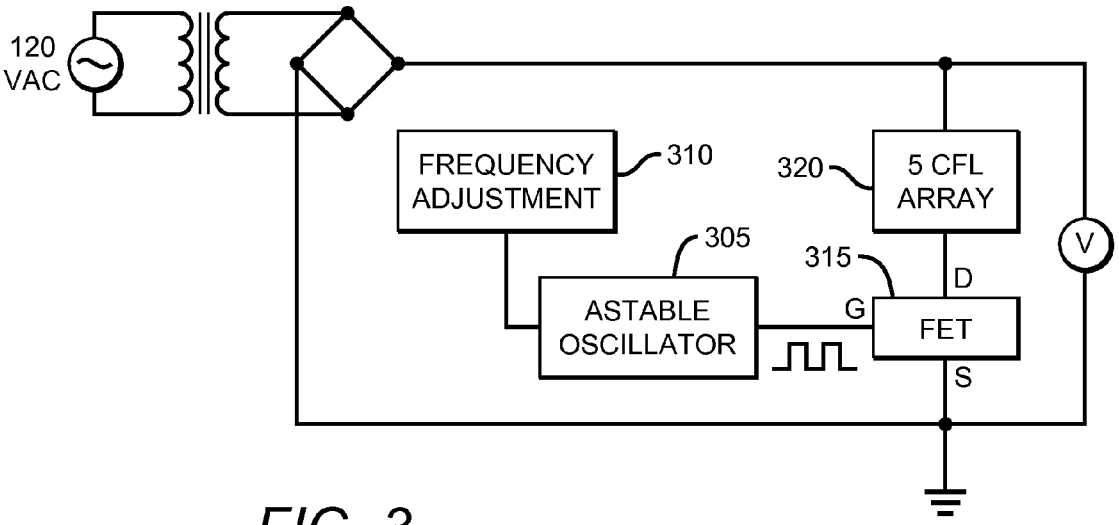
FIG. 3

| Frequency | Power | Intensity (Lux) | Lux/W | |
|---|---|---|---|---|
| 60 | 0 | 6800 | 0.068 | 0 |
| 100 | 0 | 6900 | 0.069 | 0 |
| 1000 | 0 | 8400 | 0.084 | 0 |
| 10000 | 0.4 | 23000 | 0.23 | 0.575 |
| 100000 | 0.78 | 55000 | 0.55 | 0.705128 |
| 200000 | 0.6 | 57000 | 0.57 | 0.95 |
| 300000 | 0.78 | 61300 | 0.613 | 0.785897 |
| 400000 | 0.78 | 48000 | 0.48 | 0.615385 |
| 500000 | 0.6 | 42000 | 0.42 | 0.7 |
| 600000 | 0.6 | 36000 | 0.36 | 0.6 |
| 700000 | 0.5 | 31000 | 0.31 | 0.62 |
| 800000 | 0.3 | 20800 | 0.208 | 0.693333 |
| 900000 | 0 | 9600 | 0.096 | 0 |
| 1000000 | 0 | 3000 | 0.03 | 0 |

CIRCUIT FOR DRIVING LIGHTING DEVICES

FIELD OF THE INVENTION

The field of the invention is lighting circuitry.

BACKGROUND

The following description includes information that may be useful in understanding the present invention. It is not an admission that any of the information provided herein is prior art or relevant to the presently claimed invention, or that any publication specifically or implicitly referenced is prior art.

Advancements in lighting technologies have led to more efficient lighting devices. In general, the efficiency of a lighting device can be defined by the amount of visible light output (lumens) per input power unit (watt).

For example, traditional incandescent light bulbs are generally very inefficient in producing lights, within the range of 10-17 lumens per watt. In other words, they are only able to convert five percent of input power into visible light, with the remaining power being converted into heat.

Due to the inefficiencies of the incandescent light bulbs, they have been slowly replaced by newer lighting technologies such as compact fluorescent lamps (CFL). Compared to incandescent light bulbs, CFLs are a lot more efficient in product visible light, generally rating at between 50-70 lumens per watt. In other words, CFLs are capable of converting 9-11% of input power into visible light. Even though CFLs are superior to the traditional incandescent light bulbs in terms of efficiency, they are far from optimal.

Light-emitting diodes (LEDs) have been developed and improved over the recent years to a point that they can replace incandescent lights and CFLs. The apparent advantage of LEDs is that they are much more efficient in producing visible lights than the older technologies. Numerous iterations of LEDs have been developed over the years and the latest iteration can achieve a luminous efficacy of over 90 lumens per watt.

As one can see, even though newer lighting devices with higher efficiency have been developed over the years, the process of development has been slow, and the efficiency improvement over previous technologies has not been great. In addition, a phase-out period is required each time a new lighting device is introduced to the market when consumers have to completely use up their supply of old light bulbs before they will replace them with the newer devices.

Efforts have been made to improve on existing lighting technologies without introducing new devices to the market. For example, U.S. patent publication 2012/0146534 to Yu et al., filed Jun. 14, 2012, entitled "DC/AC Inverter" discloses an efficient system for operating a fluorescent lamp by driving a circuit at around the resonant frequency according to the conduction state of the fluorescent lamp. U.S. Pat. No. 4,023,067 to Zelina et al., issued May 10, 1977, entitled "Inverter Ballast Circuit" and U.S. Pat. No. 4,973,885 to Kerwin, issued Nov. 27, 1990, entitled "Low Voltage Direct Current (DC) Powered Fluorescent Lamp" suggest that operating a fluorescent lamp at a high frequency improves the efficiency. However, only frequencies of up to 10 kHz have been experimented and only up to a luminous efficacy of 110 lumens per watt have been achieved, as disclosed in the article by J. D. Hooker entitled "Effect of Operating Frequency" which can be found at the website http://www.lamptech.co.uk/Documents/FL%20Frequency.htm.

In addition, in an attempt to improve lighting efficiency using existing large fluorescent lamp ballasts, International Patent Publication WO2012/068687 to Joset et al. filed Nov. 23, 2011, entitled "LED Lamp with Variable Input Power Supply" discloses a light emitting diode lighting device that can be used with common fluorescent fixtures (e.g., ballasts) without the need for a retrofit.

Other efforts have also been made to improve efficiency of LED lighting devices. For example, U.S. Pat. No. 8,288,924 to Ibbetson issued Oct. 16, 2012, entitled "High Efficacy White LED" discloses manipulating the current levels of the LED circuit to improve the efficiency of the LED lamps.

However, using existing technologies to drive fluorescent lamps or LED lamps still produce a large amount of heat due to inefficiency of the system. As such, there is still a need to improve on existing lighting circuits to provide more efficient lighting systems.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

SUMMARY OF THE INVENTION

The inventive subject matter provides apparatus, systems and methods for efficiently operates a lighting device. In one aspect of the invention a circuit for driving a lighting device (e.g., an LED lamp, a fluorescent lamp, etc.) is provided. According to some embodiments of the invention, the circuit comprises an oscillator that generates driving pulses at a frequency of at least 50,000 Hz, or preferably at least 100,000 Hz, or even more preferably, at least 200,000 Hz. In some embodiments, the oscillator generates the driving pulses at a frequency of less than 500,000 Hz.

In some embodiments, the oscillator of the circuit generates driving pulses at a frequency that is within 5% of a resonant frequency of the lighting device. As used herein, a resonant frequency of a lighting device is a frequency at which the lighting device operates at an optimal efficiency (e.g., a highest lumens per watt value) within a range of frequencies. In addition, the resonant frequency yields higher efficiency than frequencies that are immediately below and above the resonant frequency.

In some embodiments, the circuit further comprises a duty cycle controller that operates the pulses at a duty cycle of no more than 15%.

Each lighting device (e.g., a particular type of LED, a particular type of fluorescent lamp, etc.) has a manufacturer's specification for current consumption for a specified luminosity. Due to the efficiency achieved by the circuit, the circuit can operate the lighting device at the specified luminosity (or brighter) with a current at no more than 1/100 of the manufacturer's specification, preferably, the circuit can operate with a current at no more than 1/500, or even more preferably, at no more than 1/1,000, of the manufacturer's specification.

In addition to the current consumption, each lighting device also has a manufacturer's specification for power consumption for a specified luminosity. Due to the efficiency achieved by the circuit, the pulses provided by the circuit can have a frequency, power, and duty cycle such that the lighting device operates at no more than 75%, or preferably no more than 50%, or even more preferably no more than 20%, of the manufacturer's specification for at least the specified luminosity.

In some embodiments, the lighting device is a type of fluorescent lamp.

In some embodiments, the lighting device is an LED array. In these embodiments, the circuit comprises a MOSFET and a duty cycle controller that operates the pulses at a duty cycle within a range between 8% and 10% inclusively.

In another aspect of the invention, a method of tuning a circuit for driving a lighting device is provided. The method comprises a step of determining a resonant frequency of the circuit that includes an oscillator and the lighting device. The method also comprises a step of configuring the oscillator to generate driving pulses of current to the circuit at a frequency that is at least 50,000 Hz and that corresponds to the determined resonant frequency of the circuit.

Preferably, the driving pulses has a frequency of at least 100,000 Hz, or even more preferably, at least 200,000 Hz. In some embodiments, the oscillator generates the driving pulses at a frequency of less than 500,000 Hz.

In some embodiments, the oscillator of the circuit generates driving pulses at a frequency that is within 5% of a resonant frequency of the lighting device. As used herein, a resonant frequency of a lighting device is a frequency at which the lighting device operates at an optimal efficiency (e.g., a highest lumens per watt value) within a range of frequencies.

In some embodiments, the circuit further comprises a duty cycle controller for controlling the duty cycle of the pulses. In some of these embodiments, the method further comprises a step of configuring the duty cycle controller to operate the pulses at a duty cycle of no more than 15%.

Each lighting device (e.g., a particular type of LED, a particular type of fluorescent lamp, etc.) has a manufacturer's specification for current consumption for a specified luminosity. Due to the efficiency achieved by the circuit, the circuit can operate the lighting device at the specified luminosity (or brighter) with a much less current than the manufacturer's specification. Thus, the method of some embodiments further comprises configuring a resistor in the circuit to provide a current at no more than 1/100 of the manufacturer's specification, preferably, the circuit can operate with a current at no more than 1/500, or even more preferably, at no more than 1/1,000, of the manufacturer's specification.

In addition to the current consumption, each lighting device also has a manufacturer's specification for power consumption for a specified luminosity. Due to the efficiency achieved by the circuit, the pulses provided by the circuit can have a frequency, power, and duty cycle such that the lighting device operates at no more than 75%, or preferably no more than 50%, of the manufacturer's specification for at least the specified luminosity.

In some embodiments, the lighting device is a type of fluorescent lamp.

In some embodiments, the lighting device is an LED array. In these embodiments, the method further comprises configuring a MOSFET and a duty cycle controller in the circuit to operate the pulses at a duty cycle within a range between 8% and 10% inclusively.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 1 illustrates an example circuit for driving an LED array.

FIG. 3 illustrates an example circuit for driving a CFL array.

DETAILED DESCRIPTION

Figure 2:
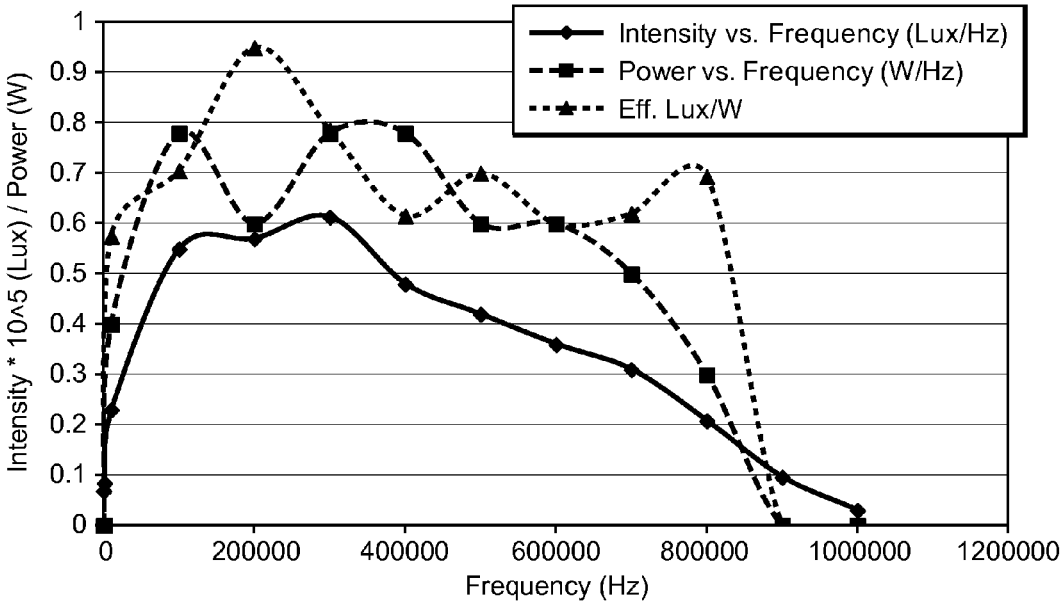
FIG. 2 illustrates the relationships between frequency of the pulses and output efficiency of the LED array.

Throughout the following discussion, numerous references will be made regarding servers, services, interfaces, portals, platforms, or other systems formed from computing devices. It should be appreciated that the use of such terms is deemed to represent one or more computing devices having at least one processor configured to execute software instructions stored on a computer readable tangible, non-transitory medium. For example, a server can include one or more computers operating as a web server, database server, or other type of computer server in a manner to fulfill described roles, responsibilities, or functions.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In one aspect of the invention, an electrical circuit that drives a lighting device in a more efficient manner is provided. In some embodiments, the electrical circuit drives the lighting device with a series of electric pulses at a high frequency and a low duty cycle. Due to its efficiency improvement over existing lighting circuits, this electrical circuit can support larger lighting arrays for commercial applications. As used herein, the efficiency of a lighting device can be defined as the amount of visible light output (lumens) per power unit (watt). The amount of visible light output is defined to include light outputs from all wavelengths that are visible by naked eyes. It is noted that a lighting device is defined herein as a device that can be connected to an electrical circuit to produce visible lights. A lighting device can include any type of fluorescent lamp (e.g., large fluorescent lamps, compact fluorescent lamps, etc.), any type of light-emitting diodes (LEDs), and incandescent lamps.

FIG. 1 illustrates an example electrical circuit 100 of some embodiments for driving LED lights. As shown, the electrical circuit 100 comprises an alternating current (AC) power source 105, a transformer 110, a high frequency pulse subcircuit 115, a high speed transistor driver 120, a transistor 125, a set of LEDs 130, and a capacitor 135.

The transformer 110 and the capacitor 135 in the circuit 100 are used in concert to act as a full-wave bridge rectifier, through which the AC power is converted into direct current (DC) power before feeding the power to the rest of the circuit 100.

The high frequency pulse circuit 115 works together with the transistor driver 120 and the transistor 125 to form an oscillator to generate a series of electric pulses at a frequency for the set of LEDs 130. In some embodiments, the transistor driver 120 is a metal-oxide-semiconductor field-effect transistor (MOSFET) driver, and the transistor 125 is a MOSFET transistor. In some embodiments, the high frequency pulse circuit 115 is configurable to control the frequency of pulses that are provided to the set of LEDs 130.

It is contemplated that providing the series of electric pulses at different frequencies to a set of LEDs yields different efficiency levels (i.e., different visible light output to power ratios). The frequencies that yield better efficiency levels for a circuit than other frequencies are called "resonant frequencies" for the circuit. As used herein, a resonant frequency can be euphemistically defined as a frequency at which the circuit can operate with higher efficiency than other frequencies within a range of frequency, where the resonant frequency is not the lowest or the highest frequency within the range. Thus, for a particular circuit, there can be more than one resonant frequency, each of the resonant frequencies being the "optimal frequency" within a local range of frequencies. It is important to identify the resonant frequencies for a particular circuit so that the circuit can be configured to provide pulses to the LEDs at a frequency that is close (e.g., within 5%) to one of the resonant frequencies.

The resonant frequencies of a particular circuit can be identified in different ways. For example, one can measure the light intensity output of the set of LEDs and the power consumption of the circuit when supplying the circuit with pulses at different frequencies. FIG. 2 shows light intensity data and power consumption data when supplying pulses at different frequencies to an example circuit to drive a set of LEDs.

In the example circuit, a serial array of thirty-seven LEDs was driven by electric pulses at 85.5 volt (V) and 8% duty cycle. When this example circuit is driven by a 120 V AC power source (without pulsing), it consumes approximately 1.8 watts. To produce the data shown in this figure, visible light intensities produced by the serial array of LED lights and the power consumptions were measured when supplying the circuit with electric pulses at frequencies ranging from 60 Hz to 1,200,000 Hz.

As shown in FIG. 2, within the range of frequencies, the LEDs produces a maximum of light output of 61,300 lux (lx) when the example circuit provides electric pulses to the LEDs at 300,000 Hz. However, when power consumption is taken into account, the circuit is at its highest efficiency (i.e., highest lumens per watt) when the circuit provides electric pulses to the LEDs at 200,000 Hz. Accordingly, for this example circuit, 200,000 Hz is identified as one of the resonant frequencies. Thus, according to some embodiments of the invention, one would configure this circuit to produce electric pulses at a frequency close to (e.g., within 5%) of 200,000 Hz to drive the serial LEDs.

It is noted that at this frequency (200,000 Hz), the power consumption of the example circuit is 0.6 watts, or one-third of the power consumption of this same circuit when driven by the 120 V AC without pulsing). In addition, the light intensity output of the LEDs when driven by electric pulses at around 200,000 Hz was measured to be 40% more than the light intensity output when driven directly with the 120 V AC without pulsing.

Most types of LED lamps behave in a way that is similar to the ones in the experiment. As such, as shown in FIG. 2, it is noted that the resonant frequencies (i.e., the frequencies that can product optimal efficiency) are usually found within the frequency range between 50,000 Hz and 500,000 Hz. As shown in the figure, the efficiency level of the LED drops significantly after passing the 500,000 Hz frequency mark.

It is also contemplated that the electric pulses with smaller duty cycle will help improve the efficiency of the circuit. As used herein, a "duty cycle" is defined as the amount of time that the circuit provides electric current to the LEDs within each time interval of a pulse. It is noted that a duty cycle of 15%, or preferably 10% provides the optimal efficiency for a circuit.

With the improved efficiency that is achieved by operating the circuit at (or close to) a resonant frequency, the circuit can drive the LEDs with a much smaller current than what is required to drive the LEDs with a direct 120 V AC. In some embodiments, a circuit providing electric pulses at or close to a resonant frequency can provide a current to the LEDs at no more than 1/100, or no more than 1/500, or even no more than 1/1,000 of the current specified by the manufacturer of the LEDs.

Similarly, with the improved efficiency that is achieved by operating the circuit at (or close to) a resonant frequency, the circuit can consume a fraction of the power that would be consumed to drive the same LEDs with a specified light intensity (luminosity) output. In some embodiments, a circuit providing electric pulses at or close to a resonant frequency can drive LEDs with a specified light intensity with no more than 75%, or even no more than 50%, of the power consumption specified by the manufacturer.

As mentioned above, the circuit disclosed herein can operate not only a single LED, but it can also work well with an LED array. When operating an LED array, it is preferably to configure the transistor and duty cycle controller to operate the pulses at a duty cycle between 8% and 10% inclusively.

Although the above description focuses on the circuit that drives LED lamps. The same principals of using high resonant frequency and low duty cycle can apply to circuits for driving other types of lighting devices, such as large fluorescent lights, compact fluorescent lights (CFLs), etc. For example, a circuit can drive a CFL with a series of current pulses at a high frequency (at least 50,000 Hz, and preferably at least 100,000 Hz, and even more preferably at least 200,000 Hz, but preferably less than 500,000 Hz). In some embodiments, the frequency of the pulses corresponds to (e.g., within 5% of) the resonant frequency of the circuit that includes the CFL.

FIG. 3 illustrates an example circuit 300 that drives a set of CFLs. As shown, the circuit 300 includes an oscillator 305, a frequency adjustment controller 310, a field effect transistor (FET) 315, and a CFL array 320. After determining the resonant frequency of this circuit 300 (using the techniques describe above), one can use the frequency adjustment controller 310 to tune the oscillator along with the FET 315 to produce pulses at a frequency that corresponds (e.g., within 5% of) to the resonant frequency of the circuit 300. For example, the resonant frequency of this circuit is determined to be 120,000 Hz. This circuit 300 can then be tuned to generate pulses at a frequency of around (within 5% of) 120,000 Hz to drive the CFLs.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A circuit for driving a lighting device having a manufacturer's specified power consumption to produce a manufacturer's specified luminosity, comprising:

a transistor connected with the lighting device in series;

an oscillator connected to the transistor in series to work with the transistor to generate driving pulses at a frequency that corresponds to a resonant frequency of the circuit and that is at least 50,000 Hz;

a transformer connected to a power source and the oscillator in series that controls a voltage of the driving pulses; and a duty cycle controller connected to the oscillator in series that operates the pulses at a duty cycle of no more than 15%, wherein a power consumption level of the circuit is a function of the pulses' frequency and duty cycle;

wherein the circuit is operating at a power consumption level based on the driving pulses' frequency and duty cycle that is no more than 75% of the manufacturer's specified power consumption to produce at least the specified luminosity.

2. The circuit of claim 1, wherein the frequency is at least 100,000 Hz.

3. The circuit of claim 1, wherein the frequency is at least 200,000 Hz.

4. The circuit of claim 1, wherein the frequency is less than 500,000 Hz.

5. The circuit of claim 1, wherein the frequency is within 5% of a resonant frequency of the lighting device.

6. The circuit of claim 5, wherein the resonant frequency is a frequency at which the lighting device operates at an optimal efficiency within a range of frequencies.

7. The circuit of claim 1, wherein the lighting device has a manufacturer's specification for current consumption for a specified luminosity, and the circuit provides a current to the lighting device at no more than 1/100 of the manufacturer's specification to produce at least the specified luminosity.

8. The circuit of claim 1, wherein the lighting device has a manufacturer's specification for current consumption for a specified luminosity, and the circuit provides a current to the lighting device at no more than 1/500 of the manufacturer's specification to produce at least the specified luminosity.

9. The circuit of claim 1, wherein the lighting device has a manufacturer's specification for current consumption for a specified luminosity, and the circuit provides a current to the lighting device at no more than 1/1000 of the manufacturer's specification to produce at least the specified luminosity.

10. The circuit of claim 1, wherein the circuit operates at no more than 50% of the manufacturer's specification based on the pulses' frequency and duty cycle to produce at least the specified luminosity.

11. The circuit of claim 1, wherein the circuit operates at no more than 20% of the manufacturer's specification based on the pulses' frequency and duty cycle to produce at least the specified luminosity.

12. The circuit of claim 1, wherein the lighting device is a light-emitting diode (LED).

13. The circuit of claim 1, wherein the lighting device is part of a light-emitting diode (LED) array, and the duty cycle controller operates the pulses at a duty cycle within a range between 8% and 10% inclusively.

14. The circuit of claim 1, wherein the lighting device is a fluorescent lamp.

15. A method of tuning a circuit for driving a lighting device having a manufacturer's specified luminosity, comprising:

identifying a plurality of resonant frequencies of the circuit comprising an oscillator, a transistor, and the lighting device, wherein the transistor is connected to the lighting device in series, wherein the plurality of resonant frequencies are within a range of frequencies above 50,000 Hz;

determining, from the plurality of resonant frequencies, an optimal resonant frequency that enables the circuit to operate at a lowest power-to-luminosity ratio; and configuring the oscillator to work with the transistor to generate driving pulses of current to the circuit at a frequency that corresponds to the determined optimal resonant frequency of the circuit to drive the lighting device to produce at least the specified luminosity; and controlling, using a transformer, a voltage of the driving pulses before feeding the driving pulses through the lighting device.

16. The method of claim 15, wherein the optimal resonant frequency is at least 100,000 Hz.

17. The method of claim 15, wherein the optimal resonant frequency is at least 200,000 Hz.

18. The method of claim 15, wherein the optimal resonant frequency is less than 500,000 Hz.

19. The method of claim 15, wherein the frequency is within 5% of the optimal resonant frequency of the circuit.

20. The method of claim 19, wherein the optimal resonant frequency is a frequency at which the lighting device operates at an optimal luminosity per watts efficiency within the range of frequencies.

21. The method of claim 15, wherein the circuit further comprises a duty cycle controller, wherein the method further comprises configuring the duty cycle controller to operate the pulses of current at a duty cycle of no more than 15% while driving the lighting device to produce at least the specified luminosity.

22. The method of claim 15, wherein the lighting device has a manufacturer's specification for current consumption to the specified luminosity, and the method further comprises configuring a resister in the circuit to provide a current to the lighting device at no more than 1/100 of the manufacturer's specification while driving the lighting device to produce at least the specified luminosity.

23. The method of claim 15, wherein the lighting device has a manufacturer's specification for current consumption, and the method further comprises configuring a resister in the circuit to provide a current to the lighting device at no more than 1/500 of the manufacturer's specification while driving the lighting device to produce at least the specified luminosity.

24. The method of claim 15, wherein the lighting device has a manufacturer's specification for power consumption for the specified luminosity, and the pulses have a frequency, power and duty cycle such that the lighting device operates at no more than 75% of the manufacturer's specification for power while producing at least the specified luminosity.

25. The method of claim 15, wherein the lighting device is a light-emitting diode (LED).

26. The method of claim 15, wherein the lighting device is a fluorescent lamp.

* * * * *